US006697579B2

(12) United States Patent
Ito et al.

(10) Patent No.: US 6,697,579 B2
(45) Date of Patent: Feb. 24, 2004

(54) FIXING UNIT WITH INDICATOR FOR SHIFTING CONTROL OF PRESSING ROLLER

(75) Inventors: Hiroshi Ito, Yamatotakada (JP); Tetsuro Tomoe, Koryo-cho (JP); Kenichi Tanabe, Hirakata (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/320,130

(22) Filed: Dec. 16, 2002

(65) Prior Publication Data

US 2003/0118356 A1 Jun. 26, 2003

(30) Foreign Application Priority Data

Dec. 25, 2001 (JP) ..... 2001-390760
Dec. 25, 2001 (JP) ..... 2001-391905

(51) Int. Cl.[7] ..... G03G 15/20
(52) U.S. Cl. ..... 399/13; 399/320
(58) Field of Search ..... 399/13, 9, 320, 399/328

(56) References Cited

FOREIGN PATENT DOCUMENTS

| | | |
|---|---|---|
| JP | 6-138791 | 5/1994 |
| JP | 6-250561 | 9/1994 |
| JP | 10-142994 | 5/1998 |
| JP | 2001-154526 | 6/2001 |

*Primary Examiner*—Quana M. Grainger
(74) *Attorney, Agent, or Firm*—Jordan and Hamburg LLP

(57) ABSTRACT

A fixing unit has a heating roller for fusing a toner image on a copy sheet thereon, a pressing roller which is rendered in pressing contact with the heating roller while the copy sheet is transported through a clearance defined by the heating roller and the pressing roller, and a control lever which is operative to selectively move the pressing roller toward and away from the heating roller so as to set the fixing unit between a pressing-contact state where the pressing roller is pressed against the heating roller and a released state where the pressing roller is set away from the heating roller. A warning display member bearing information relating to manipulation of the control lever is detachably attached to the control lever in such a manner as to be removable from the control lever by pulling the warning display member generally in the same direction as manipulating the control lever to set the fixing unit to the pressing-contact state.

13 Claims, 8 Drawing Sheets

FIXING UNIT WITH INDICATOR FOR SHIFTING CONTROL OF PRESSING ROLLER

BACKGROUND OF THE INVENTION

1. Field of the Invention

This invention relates to an image forming apparatus such as a copier or a printer, and more particularly pertains to a fixing unit for use in such an image forming apparatus for fixing a toner image onto a copy sheet. The fixing apparatus incorporates a heating roller or heat roller for fusing a toner image on the copy sheet and a pressing or pressure roller which is rendered in pressing contact with the heating roller to form a nip through which the copy sheet is transported for image fixation. This invention also relates to such an image forming apparatus provided with the fixing unit.

2. Description of the Related Art

A heater-type fixing unit for use in an image forming apparatus such as a copier and a printer generally has a cylindrical heating roller heated to a certain temperature and a cylindrical pressing roller which is rendered in pressing contact with the heating roller to form a nip between the heating and pressing rollers. A toner image which has been transferred onto a copy sheet, is fused by the heating roller and fixed on the copy sheet while the copy sheet is passing through the nip defined by the heating roller and the pressing roller.

Generally, in the above-mentioned fixing unit, the pressing roller is composed of a resilient material and is pressed against the heating roller. Specifically, the nip is defined by the contact surface on the outer surface of the heating roller and the contact surface of the pressing roller which is in pressing contact with the heating roller. While a copy sheet bearing a toner image is transported through the nip defined by the heating roller and pressing roller which are rotating, the toner image is fixed on the copy sheet by the heat of the heating roller and the pressing force is exerted to the copy sheet by the pressing roller.

Once the fixing unit is initialized for operation, the pressing roller of resilient material is constantly in pressing-contact with the heating roller at the nip with the result that it is highly likely that the resilient property of the pressing roller is deteriorated as time lapses in the case where the fixing unit is left unused for a long term, because the pressing roller is always under stress.

In view of the above, it is often the case that the image forming apparatus equipped with the fixing unit of the above mentioned construction is shipped or delivered to a customer with the pressing roller being kept off or away from the heating roller, namely, in a released state where the pressing roller is released from the pressing-contact against the heating roller. The pressing-contact is released to prevent the pressing roller having a certain resilient property, from being deformed due to unnecessary application of external force during a time period e.g. from shipment to installment and initialization of the image forming apparatus for actual use. In such a condition, after purchasing the image forming apparatus, a user has to resume the fixing unit to a pressing-contact state by him/herself to render the image forming apparatus (fixing unit) to an operable state.

An arrangement is conventionally known in which the fixing unit is selectively brought to a pressing-contact state where the pressing roller is pressed against the heating roller and a released state where the pressing roller is kept away from the heating roller by the manipulation of a control lever associated with the fixing unit. However, even with provision of such a control lever, a user may forget to set the control lever to the pressing-contact state, or inadvertently attempt to activate the image forming apparatus without setting the fixing unit to the pressing-contact state. With such a user's inadvertent operation and/or negligence of resuming the fixing unit to the pressing-contact state, it is highly likely to occur a mal-function of the image forming apparatus.

For example, the heating roller may be overheated as the pressing roller is not in contact with the heating roller and the heat produced by a heater within the heating roller is not shared by the heating and pressing rollers so that the heat roller may be heated rapidly above an allowed level before thermo-control system reacts, resulting in damage of the heat roller in worst case. A copy sheet may be jammed in the gap between the heating and pressing rollers in disengaged state, thus leading to failure in discharging the sheet. The image forming apparatus may indicate that an error is occurring and stop its operation, in response to detection of mal-function of the apparatus, such as the over-heating of the heating roller or sheet delivery error.

In view of the above, there has been proposed a fixing unit 101 as shown in FIG. 8.

The fixing unit 101 shown in FIG. 8 incorporates a heating roller 103 and a pressing roller 102. Control levers 105 are provided in the fixing unit 101 to selectively set the fixing unit 101 between a pressing-contact state and a released state. At the time of shipment or delivery, a strip member 104 as shown in FIG. 8 is adhered by a manufacturer to each control lever 105 with a front surface of the strip bearing a message to indicate a user the necessity of setting the lever to the pressing contact position. The message indicates a user that the control levers 105 should be manipulated in such a direction as to render the pressing roller 102 in pressing contact against the heating roller 103 before the user activates the image forming apparatus.

Specifically, each strip member 104 is adhesively attached to the front surface of the control lever 105 in such a manner that a user can notice the message on the front surface of the control lever 105 while the control lever 105 of the fixing unit 101 extends downward from the pressing roller 102. The pressing roller 102 is kept off or away from the heating roller 103 when the control lever 105 extends downward and the annular portion 106*a* of a cam 106 engages the disk 107 which is provided on opposite ends of the heating roller 103 coaxially with but independently of the heating roller 103. The cams 106*a* is provided on opposite ends of the pressing roller 102 coaxially with but independently of the pressing roller 102. The strip member 104 bears, for example, a message on the front surface thereof to indicate the a user that the fixing unit 101 should be brought to a pressing-contact state by turning the control lever 105 upward before use, until the recessed portion 106*b* of the cam 106 comes into engagement with the disk 107.

Although not illustrated in FIG. 8, the message may be any message as far as the message indicates or warns a user to use the apparatus under a requested condition, for example, "Lift the lever up before use!" The strip member or seal 104 is usually adhered to the free end of the control lever 105 sideway as shown in FIG. 8 to facilitate removal of the strip 104 before initiation of the image forming apparatus.

However, there sometimes arises a case that a user may inadvertently remove the strip member 104 without reading the message thereon and attempt to activates the apparatus, leaving the control lever 105 at the initial downward extending state to keep the heating roller 103 away from the pressing roller 102 despite the fact that the message is displayed on the strip member 104 on the front surface of the control lever 105, i.e., a site where the user can notice the message. Thus, the above idea of attaching the strip member 104 to urge the user to use the apparatus in a certain requested condition may fail because the user may forget to manipulate the control lever 105 according to the instruction on the strip member 104, for instance. In such a case, as described above, an error indication may occur during activation of the apparatus, the heating roller may be damaged or broken due to the overheat when the apparatus is activated, or a copy sheet may be jammed.

Also, the conventional fixing device 101 may be constructed such that the control lever 105 is set to an intermediate position indicated by the symbol ③ (see FIG. 9) where a heating roller 103 and a pressing roller 102 are rendered in light or slight contact with each other or kept away from each other with a little clearance so that a user can easily remove a jammed sheet. Hereinafter, the position ③ is called "maintenance position" as the removal of the jammed sheet is considered as operation for maintaining the image forming apparatus.

Referring to FIG. 9, the fixing unit 101 is provided with a covering member 106 covering the heating roller 103 and pressing roller 102, and is installed in a housing 3 of an image forming apparatus. The covering member 106 is formed with guide slots 9 through which the control levers 105 extend such that the control levers 105 are guided by the slots 9. A door 31 is hinged on sidewalls of the housing 3 to open and close the opening of the housing 3 for the access to the control levers 105. When a user opens the door 31 and sets the control lever 105 to the maintenance position ③, the user is allowed to access the interior of the housing 3, and to pull out the jammed paper at upstream or downstream of the fixing unit not shown but in a conventional way.

If the user attempts to close the door 31 with the control lever 105 being left at the maintenance position ③, for instance, then, the control lever 105 left at the maintenance position ③ blocks the door 31 from being closed, and the user is reminded of returning the control lever 105 from the maintenance position ③ to an operable position ② corresponding to a pressing-contact state of the fixing unit 101 where the pressing roller 102 is pressed against the heating roller 103. However, if the user inadvertently shifts the control lever 105 to an initial position ① corresponding to a released state of the fixing unit 101 where the pressing roller 102 is kept away from the heating roller 103, even in such a condition, the user is enabled to close the door 31 without interference of the control lever 105. Thus, this arrangement fails to prevent erroneous operation of a user of manipulating the control lever 105 from the maintenance position ③ to the initial position ③.

SUMMARY OF THE INVENTION

In view of the above, it is an object of this invention to provide a fixing unit for an image forming apparatus constructed to avoid operator's failure in setting the fixing unit to a normal-use condition.

It is another object of the present invention to provide a fixing device for an image forming apparatus capable of avoiding activation of the fixing device under inadequate condition.

It is still another object of the present invention to provide a fixing device for an image forming apparatus, having a safety or fail-safe mechanism for leading a user to set the fixing device to a normal operating condition before activating the fixing unit.

It is a further object of the present invention to provide a fixing device for an image forming apparatus, in which a mechanism prevents a user from inadvertently setting the fixing device to an unfavorable condition. It is still further object of the present invention to provide an image forming apparatus including a fixture attaining one or more of the objects as mentioned above.

According to an aspect of this invention, a fixing unit according to this invention comprises: a heating roller for fusing a toner image on a sheet; a pressing roller which is rendered in pressing contact with the heating roller to form a nip between the heating roller and the pressing roller with the sheet being transported through the nip; a control member selectively settable to a first position for keeping the pressing roller off the heating roller and to a second position for keeping the pressing roller in press-contact with the heating roller; and a manipulation member operable to shift the control member between the first and second positions, and an indication member for indicating necessity of shifting the control member from the first to second position before the actuation of the fixing unit, the indication member is associated with the manipulation member such that removal of the manipulation member is accompanied by the shifting of the control member from the first to second position.

According to an embodiment of the present invention, the control member is in the form of a control lever which pivots to selectively set the fixing unit to a pressing-contact state where the pressing roller is pressed against the heating roller and a released state where the pressing roller is off the heating roller. The indication member has a form of a sheet which is detachably attached to the control lever in such a manner that the indication member is removed from the control lever by pulling the indication member in a direction to turn the control lever from the first to second position.

The above mentioned aspect of the present invention prevents the user from forgetting to set the fixing unit to the pressing-contact state after removal of the indication member, since the shifting of the control member from the first to second position when the user try to remove the indication member.

According to another aspect of the present invention, the fixing unit is provided with a block mechanism to prevent the user from erroneously shifting the control member from the first to second position. According another form of the embodiment of he present invention, the control lever is settable to a third position for releasing the pressing contact of the pressing roller with the heating roller and the block mechanism is constructed to prevent the control lever from moving to the first position from the second or third position.

These and other objects, features and advantages of the present invention will become more apparent upon a reading of the following detailed description and accompanying drawing.

DESCRIPTION OF THE PREFERRED EMBODIMENTS

Figure 1:
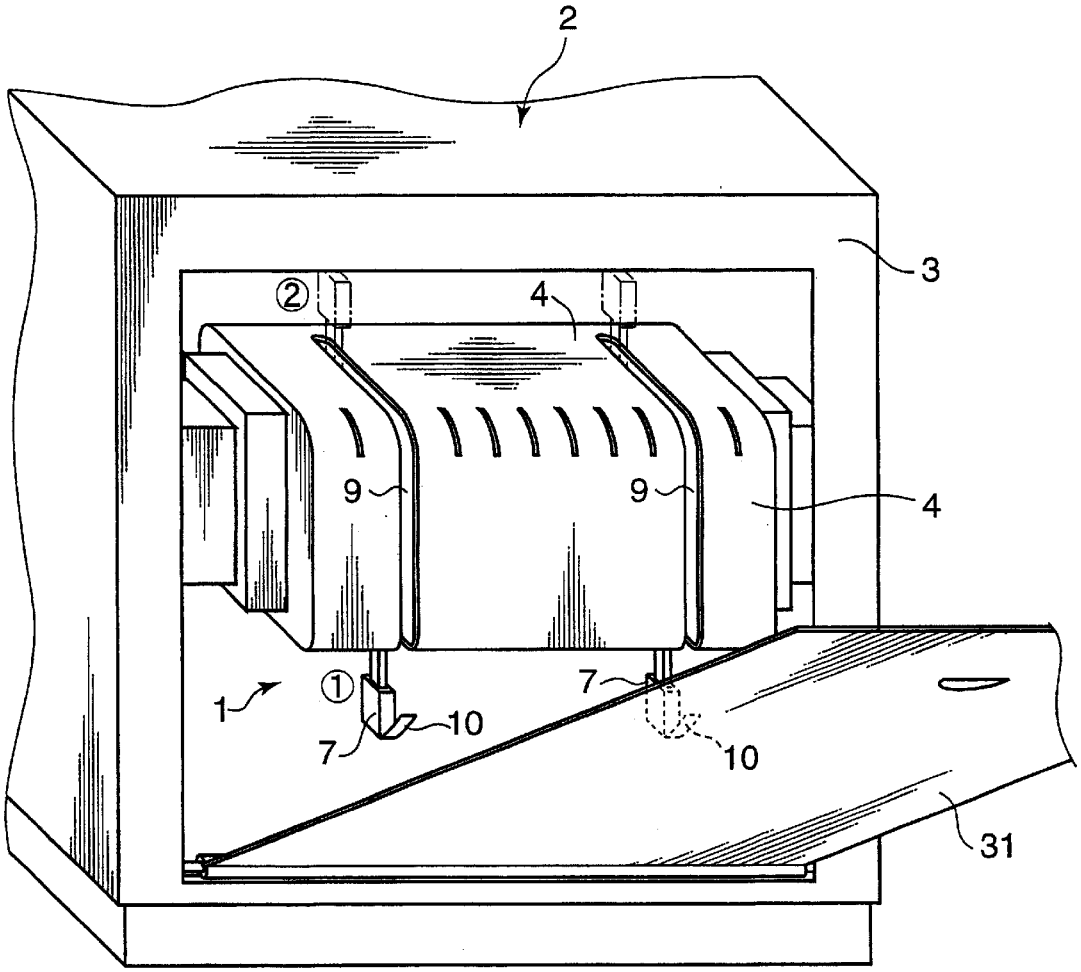
FIG. 1 is a diagram showing an image forming apparatus equipped with a fixing unit in accordance with a first embodiment of this invention.

Hereinafter, preferred embodiments of this invention are described with reference to the accompanying drawings. It should be appreciated that like elements among the drawings are denoted with like reference numerals, and a repeated description thereof is avoided.

Figure 2:
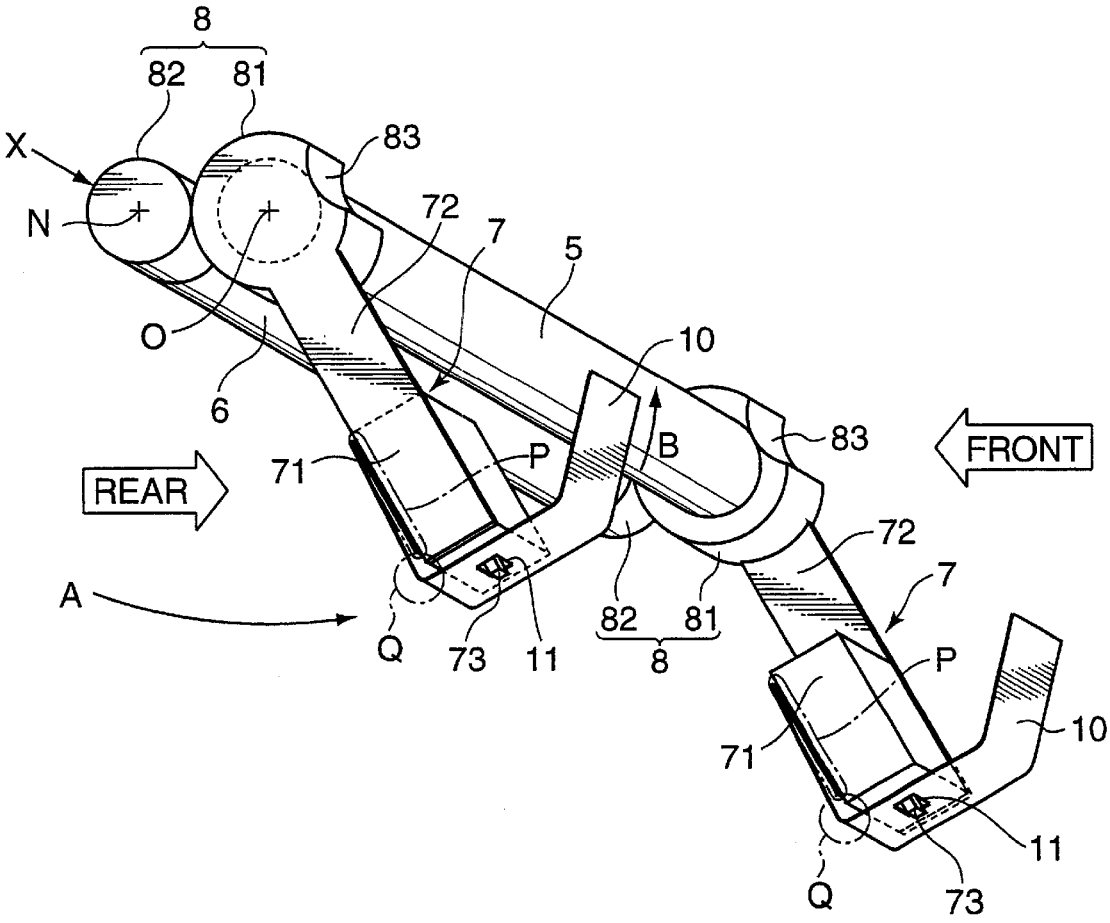
FIG. 2 is a perspective view showing the fixing unit shown in FIG. 1.
Figure 3B:
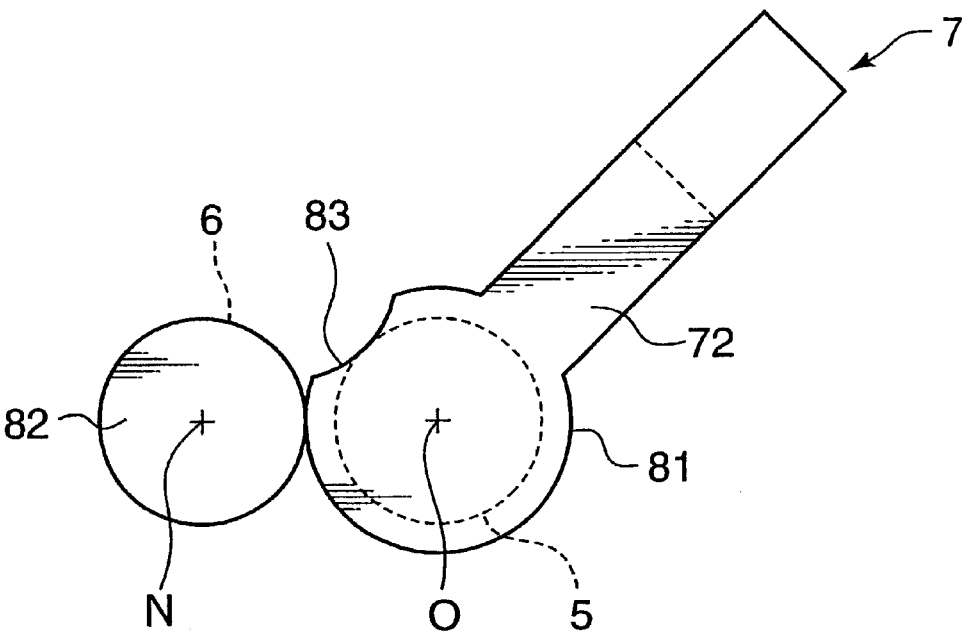
FIGS. 3A and 3B schematically illustrates an example of a cam mechanism to move a pressing roller toward and away from a heating roller in the fixing unit shown in FIG. 1.
Figure 3A:
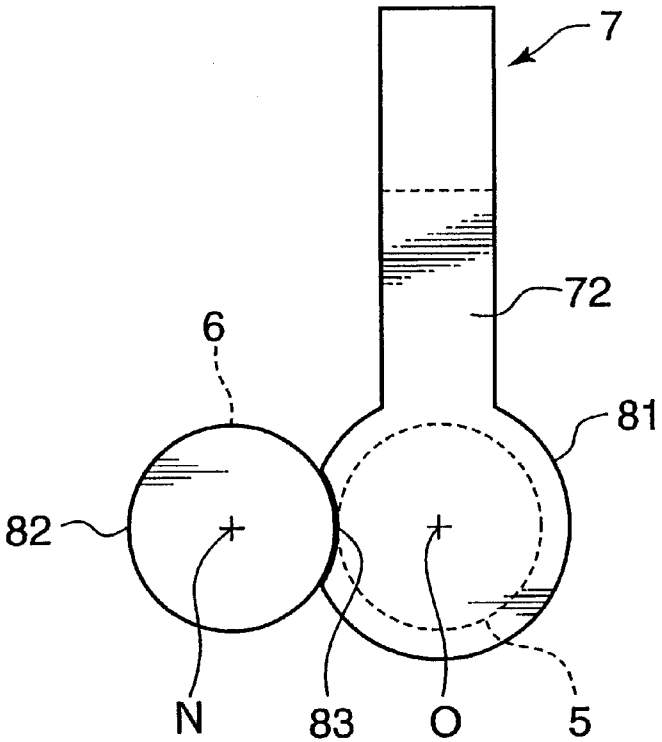

A fixing unit 1 and an image forming apparatus 2 in accordance with a first embodiment of this invention will be described referring to FIGS. 1 through 4. FIG. 1 schematically shows a construction of the fixing unit 1 and the image forming apparatus 2 in accordance with the first embodiment of this invention. FIG. 2 is a perspective view showing the fixing unit 1 shown in FIG. 1. FIGS. 3A and 3B are diagrams showing a cam mechanism 8 viewed from the direction of X in FIG. 2.

The fixing unit 1 is incorporated in a housing 3 of the image forming apparatus 2 and includes a covering member 4, a heating roller 6, a pressing roller 5, a control lever 7, a cam mechanism 8, and a guide slot 9. The heating roller 6 incorporates a heating source therein. The heating roller 6 and the pressing roller 5 are accommodated in the covering member 4. The pressing roller 5 is relatively moved toward and away from the heating roller 6 by rotating or turning the control lever 7 to predetermined positions. The control lever 7 is selectively set to the predetermined positions to control the cam mechanism 8. A guide slot 9 is formed in the covering member 4 such that the guide slot 9 extends in a region along which the control lever 7 is guided between an initial position (indicated by the symbol ① in FIG. 1) i.e., the position at the time of shipment of the image forming apparatus, and an operable position (indicated by the symbol ② in FIG. 1) where the fixing unit 1 (image forming apparatus 2) is ready to operate. A door 31 is mounted on sidewalls of the housing 3 by way of a hinge or its equivalent to open and close the opening where the fixing unit 1 is exposed. When the door 31 is opened, a user is allowed to manipulate the control lever 7.

With the above construction, while the image forming apparatus is on the way of transportation from a manufacturer to a customer, or is stored in a shop as a stock, for example, the heating roller 6 and the pressing roller 5 are kept away from each other by positioning the control lever 7 at the initial position ①. Hereinafter, the initial position ① is also called as "shipping position". With this arrangement, when the fixing unit 1 is expected to be left unused for a long term, the control lever is positioned at the shipping position ① to keep the pressing roller 6 off or away from the heating roller and prevent unnecessary deterioration and deformation of the resilient member composing the outer surface of the pressing roller 5.

When the control lever 7 is turned to the operable position ②, the pressing roller 5 is moved to the heating roller 6 and brought into pressing contact against the heating roller 6 to thereby define a nip between the heating roller 6 and the pressing roller 5. Hereinafter, the operable position ② is also called as "normal-use position". Thus, a toner image on a copy sheet is fixed thereto by the heat of the heating roller 6 and the pressing force exerted to the copy sheet by the pressing roller 5, while the copy sheet is transported through the nip.

As shown in FIG. 2, a pair of disk-like contact rollers 82, each having a diameter substantially equal to that of the heating roller 6 are provided at opposite ends of the heating roller 6 coaxially with but independently of the heating roller 6. A pair of disc-like cam 81 having a diameter larger than that of the pressing roller 5 are provided at opposite ends of the pressing roller 5 coaxially with but independently of the pressing roller 5 such that each cam 81 engages the corresponding contact roller 82 under pressure for urging the pressing roller 6 against the heating roller 5. The cams 81 and the contact rollers 82 constitute the cam mechanism 8. Some urging mechanism (not shown) is provided to urge the pressing roller 6 against the heating roller 5 as is well-known in the art.

A rod 72 extends from each cam 81 radially outwardly. A generally parallelepiped knob 71 is formed at or integrally attached to a distal end portion of each rod 72. The knob 71 and the rod 72 constitute the control lever 7. A projection 73 is formed at a top portion of each knob 71.

An indent portion or recess 83 is formed at an appropriate position in an outer circumference of the cam 81. The indent portion or recess 83 is curved to be complementary with the curvature or circumference of the contact roller 82 to fit each other. As shown in FIG. 3A, when the control lever 7 assumes upward position, part of the contact roller 82 is fitted in the indent portion 83 of the cam 81, to bring the pressing roller 5 into pressing contact with or against the heating roller 6.

On the other hand, when the control lever 7 is pivotally rotated about the axis of rotation O downward as shown in FIG. 3B, the part of the contact roller 82 that has been fitted in the indent portion 83 slips out of the indent portion 83, whereby the pressing roller 5 is moved away from the heating roller 6 with the annular surface of the cam 81 abutting against the outer surface of the contact roller 82.

Referring back to FIG. 2, an adhesive strip member 10, an example of an warning or indication display member, is detachably attached to the knob 71. The strip member 10 bears, on a front surface thereof, notes or notification relating to manipulation of the control lever 7. The indication relating to manipulation of the control lever 7 includes, for example, text message that urges or indicates a user to shift the control lever 7 to the upright position before use of the image forming apparatus to bring the pressing roller 5 into pressing contact with the heating roller 6, text message that urges or indicates a user to remove the strip member 10 by pulling the strip member 10 in a prescribed direction before use, and/or a pictorial image such as a symbol of an arrow indicative of a direction along which the strip member 10 is to be pulled, and an indication representing a manner of removing the strip member 10.

The strip member 10 may include a sheet-like member such as a filament tape. FIG. 2 shows a state that the control lever 7 is at the initial position ① to set the fixing unit 1 in a released state where the pressing roller 5 is kept away from the heating roller 6. Referring to FIG. 2 one end portion (proximal end portion) of the strip member 10 is detachably attached to the knob 71 on the side P indicated by the broken line, namely, on a rear surface of the knob 71 in the direction of manipulating the control lever 7 (direction shown by arrow A). The strip member 10 extends forward, i.e. in the direction shown by arrow A with its free end extends beyond the knob 71 such that the user may nip or pinch and hold the free end of the strip member 10 and pull it in the directions shown by the arrow A and B. Further, an opening 11 is formed in the strip member 10 at a position corresponding to the position of the projection 73 such that the projection 73 extends through the opening 11 while the strip member 10 is attached to the knob 71.

In the embodiment, the strip member 10 bears information relating to manipulation of the control lever 7. Alternatively, as far as the manner of manipulating the control lever 7 or the manner of removing the strip member 10 is obvious to a user, information relating to manipulation of the control lever 7 may be omitted. The manner as to how the strip member 10 is attached to the knob 71 is described in detail with reference to FIG. 2 and FIG. 4.

FIG. 2 shows a state that the proximal end portion of the strip member 10 is detachably attached to the knob 71 at the site P. In this state, when a user pulls the free end (distal end portion) of the strip member 10 in the direction shown by arrow B, the control lever 7 is pivotally rotated about the axis of rotation O to an operable position ② for a pressing-contact state of the fixing unit 1.

Specifically, the strip member 10 has the proximal end portion thereof adhesively attached to the knob 71 at the rear site P of the knob 71, engaging portion bent at a site Q indicated by the circle of broken-line and the free end portion extending toward the opening of the image forming apparatus and slightly bending upwards at an intermediate of the free portion of the strip member 10. The projection 73 fits in the opening 11 of the strip member 10 and protrudes from the strip member 10.

In the above state, when a user nips and pulls the distal end portion of the strip member 10 in the direction of arrow B, the control lever 7 is pivotally rotated about the axis of rotation O in the direction of arrow A. Roughly speaking, the directions of arrows A and B are generally the same. The strip member 10 may bear pictorial image such as an arrow indicative of the direction along which a user is requested to pull the strip member 10 or indication of the manner of removing the strip member 10 to guide the user to pull the strip member 10 in the direction of arrow B.

Since the projection 73 extends through the opening 11 while the strip member 10 is adhesively attached to the knob 71, a user's force to pull the strip member 10 is transmitted, without failure, to the knob 71 by way of the fitting of the projection 73 in the opening 11 when the user attempts to pull the strip member 10 in the direction of arrow B, thus pivotally rotating the control lever 7 in the direction of arrow A. In case, however, where the adhesive force of the strip member 10 to the knob 71 is sufficient for the rotation of the control lever 7, the projection 73 and the opening 11 may be omitted.

Figure 4:
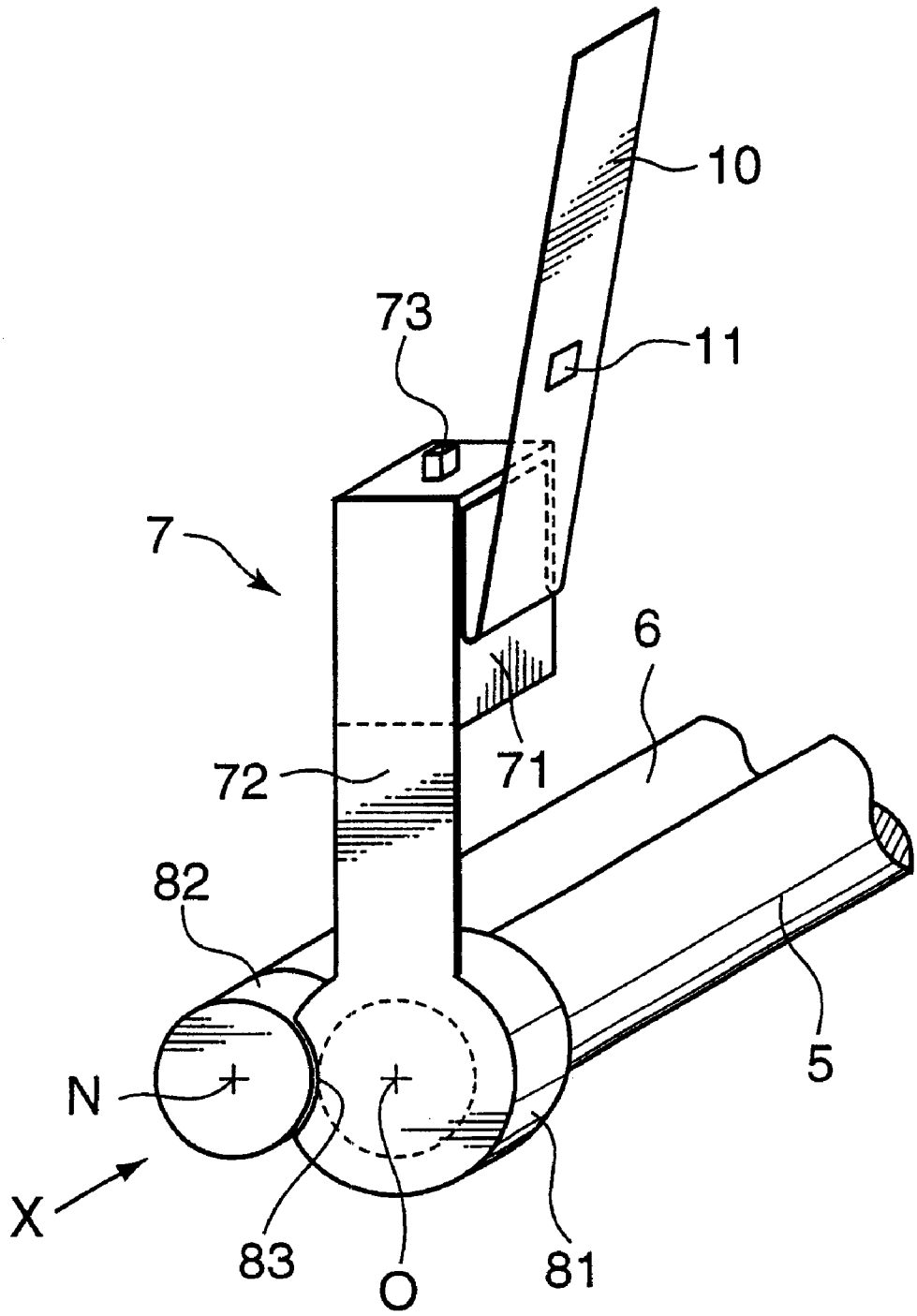
FIG. 4 schematically illustrates an example of the cam mechanism to move a pressing roller toward and away from the heating roller in the fixing unit shown in FIG. 1.

Further, the projection 73 is released from the opening 11, as the control lever 7 turns from a downward-directed posture, i.e., initial position ① to an upright posture, i.e., operable position ②. FIG. 4 shows the control lever 7 at the upward-directed or upright posture. When the strip member 10 is pulled further upward after the control lever 7 reaches the upright position shown in FIG. 4, the strip member 10 is removed or peeled off from the knob 71.

In this way, the removal of the strip member 10 is accompanied by the upward pivotal movement of the control lever 7. This arrangement prevents a user from failing to set the control lever 7 to an operable or normal-use position (set the rollers to a pressing-contact state), thus avoiding the trouble of the fixing device 1 due to the failure in setting the control lever, such as the overheating of the heating roller, jamming of sheet, and so forth.

Preferably, while the control lever 7 is at the initial position ① as shown in FIG. 2, the proximal end portion of the strip member 10 is adhesively attached to the rear surface of the knob 71 of the control lever 7 as viewed from a user, and the strip member 10 may be bent in such a direction that the distal end portion thereof faces the front side of the control lever 7, namely, faces the user on service. This way of attaching the strip member 10 to the control lever 7 enables a user to easily remove the strip member 10 when the user manipulates the control lever 7 to set the fixing unit 1 to the operable position.

Next, a second embodiment of this invention will be described with reference to FIGS. 5A through 7C.

Figure 5A:
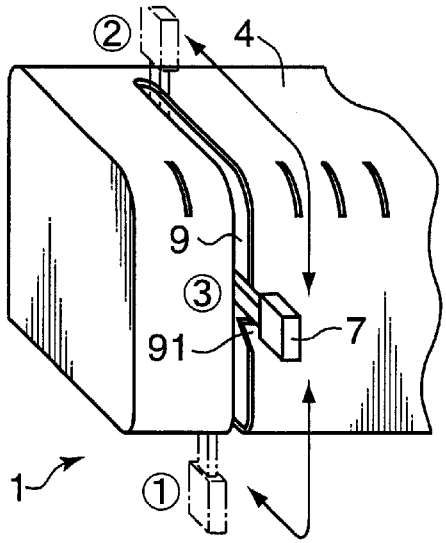
FIGS. 5A and 5B partly show a fixing unit in accordance with a second embodiment of this invention.
Figure 5B:
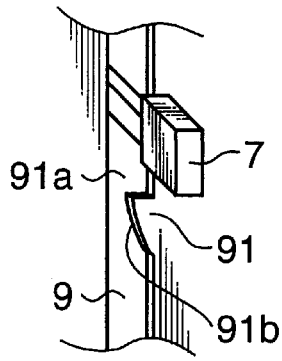

FIGS. 5A and 5B are diagrams showing the features of a fixing unit 1 in accordance with the second embodiment. The fixing unit 1 in the second embodiment is different from the fixing unit 1 in the first embodiment in the following points. Specifically, in the fixing unit 1 shown in FIGS. 5A and 5B, a wedge-like projection 91, an example of a restricting member, is formed on one of the side edges defining a guide slot 9. FIG. 5B is a partly enlarged view of the guide slot 9 where the wedge-like projection 91 is formed on an edge. The wedge-like projection has a right-angle portion 91*a* and tapered portion 91*b*. The right-angle portion 91*a* extends toward the center of the slot at right angle with the edge.

The fixing unit 1 in the second embodiment has a cam mechanism 8 similar to the cam mechanism 8 of the first embodiment as shown in FIG. 2. The cam mechanism 8 of the second embodiment includes a cam 84 and a contact roller 82 of the shapes as shown in FIGS. 7A through 7C. The cam 84 and contact roller 82 are respectively fixed to the heating roller and pressing roller as in the case of the first embodiment. A user is allowed to perform maintenance of the fixing unit 1 such as removal of a jammed sheet by setting a control lever 7 to a maintenance position ③ (see FIGS. 6A through 6C).

Figure 6A:
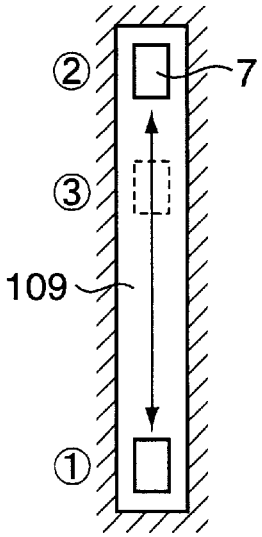
FIG. 6A schematically illustrates a track of movement of a control lever employed in the first embodiment.
Figure 6B:
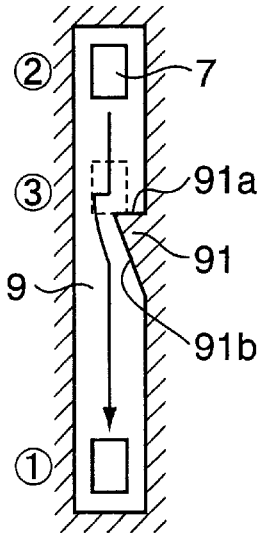
FIGS. 6B and 6C schematically illustrate a track of movement of a control lever in the fixing unit in accordance with the second embodiment.
Figure 6C:
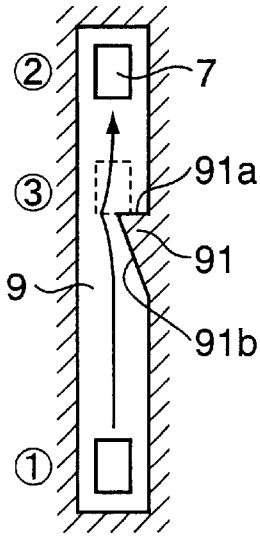
Figure 7A:
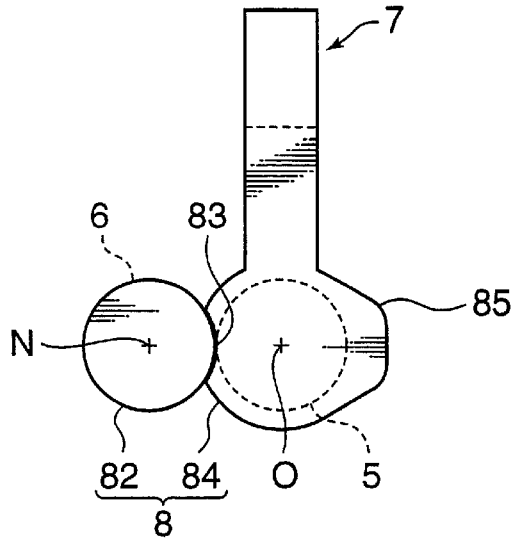
FIGS. 7A through 7C schematically illustrate an example of a cam mechanism to move a pressing roller toward and away from a heating roller in the fixing unit shown in FIGS. 5A and 5B.
Figure 7B:
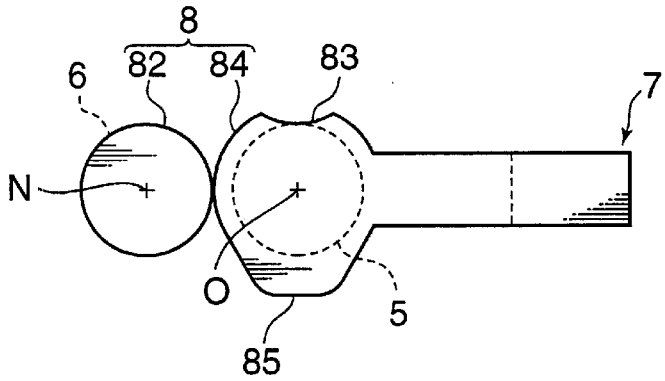
Figure 7C:
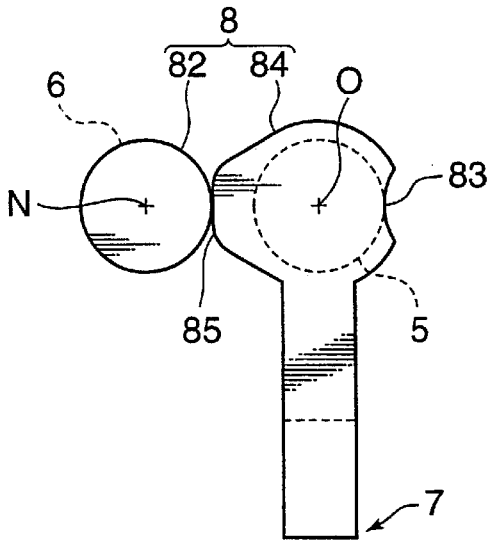
Figure 8:
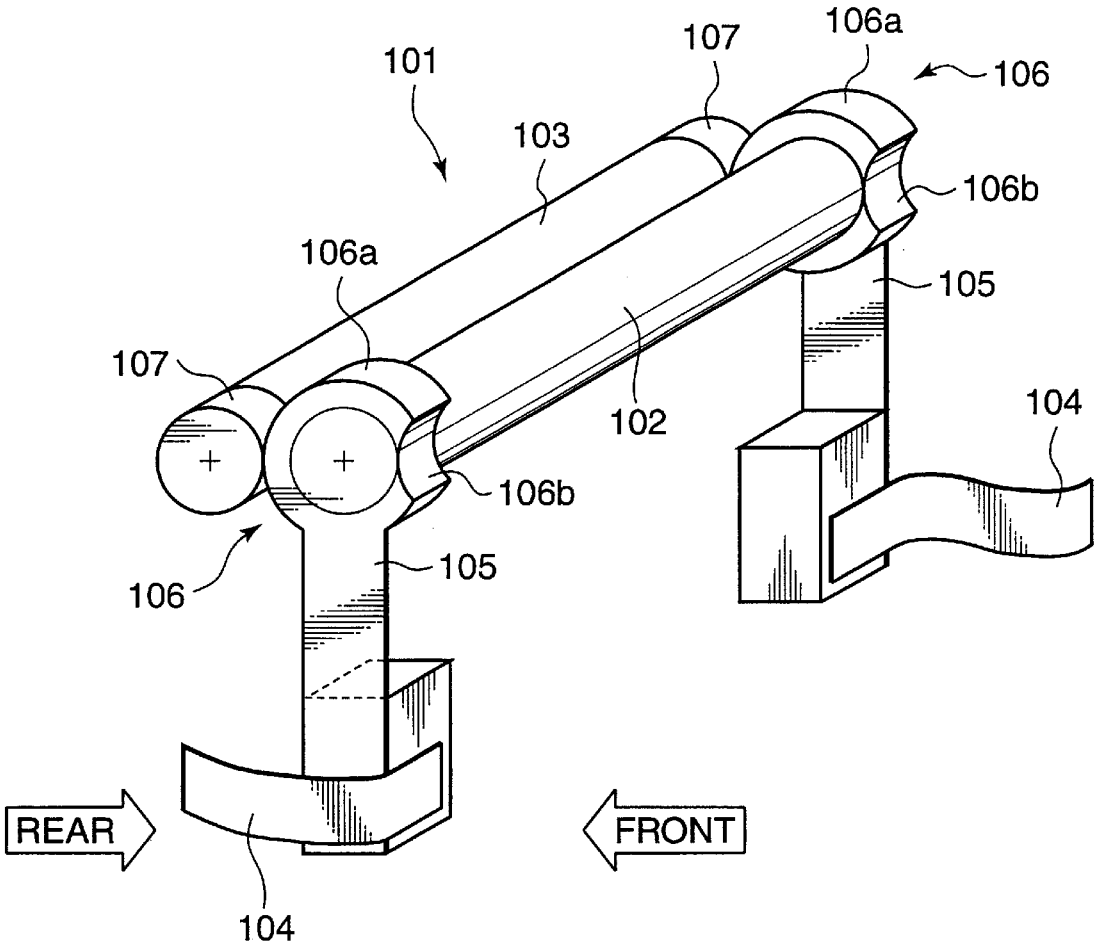
PRIOR ART FIG.8
FIG. 8 is a perspective view schematically showing a construction of a conventional fixing unit.
Figure 9:
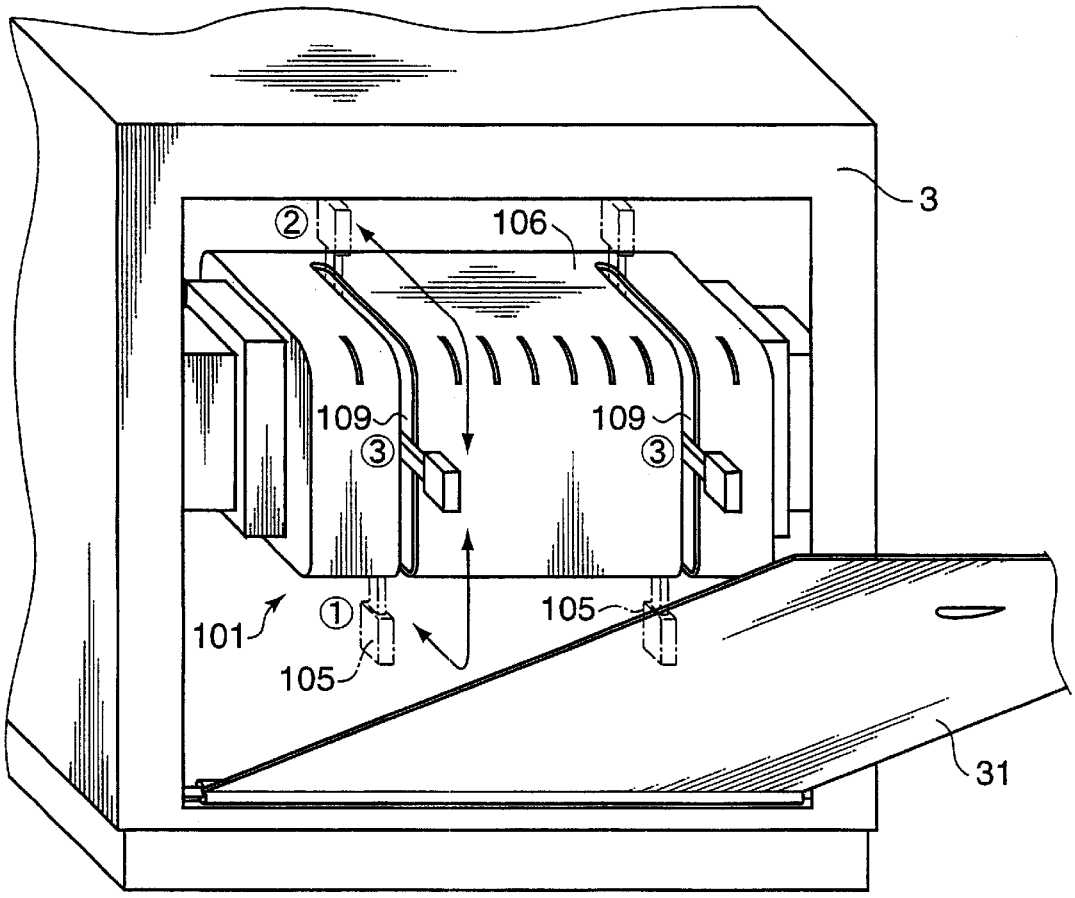
PRIOR ART FIG.9
FIG. 9 is a partial perspective view of a conventional image forming device incorporating the fixing unit shown in FIG. 8.

FIG. 6A is a diagram showing a track of movement of the control lever 105 of the fixing unit 101 of the first embodiment. FIGS. 6B and 6C are diagrams each showing a track of movement of the control lever 7 of the fixing unit 1 in the second embodiment of this invention. FIGS. 7A through 7C illustrate the cam mechanism 8 of the fixing unit 1 in the second embodiment as viewed in the direction of axis of rotation O (N).

Similar to the fixing unit 1 of the first embodiment, the fixing unit 1 of the second embodiment includes a covering member 4, a pressing roller 5, a heating roller 6, the control lever 7, and the guide slot 9. The covering member 4 encases the pressing roller 5, the heating roller 6, and peripheral devices therein. The control lever 7 is pivotable about an axis of rotation which is coaxial with the heating roller 5., and is selectively settable to an initial or shipping position ①, a maintenance position ③, and an operable or normal-use position ② to selectively move the pressing roller 5 toward and away from the heating roller 6 as required. The guide slot 9 is formed in the covering member 4 such that the control lever 7 is guided between the shipping position ① and the operable position ②.

The fixing unit 1 of the second embodiment will be described with reference to FIGS. 7A through 7C. A pair of disk-like contact rollers 82 each having a diameter substantially equal to that of the heating roller 6 are provided at axial opposite ends of the heating roller 6 coaxially with but independently of the heating roller 6. The heating roller 6 rotates about the axis of rotation N. A pair of disc-like cam 84 each having an annular portion of a diameter slightly larger than that of the pressing roller 5 are provided at axial opposite ends of the pressing roller 5 coaxially with but independently of the pressing roller 5. The pressing roller 5 rotates about an axis of rotation O independently of the cam 84. Each cam 84 engages the corresponding contact roller 82 under pressure exerted to the pressing roller 5. The control lever 7 extends from each cam 84 radially outwardly. An indent portion or recess 83 and a projection 85 are formed at an appropriate position on the outer circumferential portion of the cam 84.

When the control lever 7 is set at an upright posture as shown in FIG. 7A, namely, to the operable position ② shown in FIG. 5A, part of the contact roller 82 is fitted in the indent portion or recess 83, whereby the cam 84 is brought to a locked state and the pressing roller 5 is pressed against the heating roller 6.

Then, as shown in FIG. 7B, when the control lever 7 is pivotally rotated from the operable position ② to the maintenance position ③ shown in FIG. 5A, the part of the contact roller 82 that has been fitted in the indent portion 83 of the cam 84 slips out of the indent portion 83, and the outer surface of the cam 84 abuts against the outer surface of the contact roller 82, whereby the pressing roller 5 is brought to a light contact with the heating roller 6, or opposes the heating roller 6 with a small clearance.

Then, as shown in FIG. 7C, when the control lever 7 is further pivotally rotated downward from the maintenance position ③ to the initial position ① shown in FIG. 5A, the outer surface of the contact roller 82 abuts against the projection 85, whereby the pressing roller 5 is away from the heating roller 6 sufficiently to avoid inadvertent engagement of the rollers 5 and 6.

Alternatively, the control lever 7 may be mounted on only one of the cams 84 that have been provided at the respective axial opposite ends of the heating roller 6, while the other one of the cams 84 is mechanically linked with the one of the cams 84 such that operation of the single control lever 7 turns both of the cams 84. Further alternatively, a single set of the cam 84 and the contact roller 82 may be provided at either one axial end of the heating roller 6 and the pressing roller 5, respectively.

With this arrangement, the control lever 7 is pivoted about the axis of rotation O of the pressing roller 5, and is selectively settable to one of the predetermined positions for positioning the pressing roller 5 relative to the heating roller 6 depending on the required condition of the fixing unit 1. For instance, if the fixing unit 1 is expected to be left unused for a long-term, e.g., when the fixing unit 1 is stored in a storage site as a stock, the above arrangement avoids inadvertent setting of the control lever 7 at the initial position or the shipping position ①, thereby avoiding unexpected deterioration and deformation of the resilient member constituting the outer surface of the heating roller 6.

Referring back to FIGS. 5A and 5B, the wedge-like projection 91 formed on one of the edges defining the guide slot 9 blocks a user from inadvertently turning the control lever 7 from the maintenance position ③ or from the operable or normal-use position ② to the shipping or initial position ①. In other words, the user is allowed to shift the control lever 7 to the initial position ① only when he or she exerts a force onto the control lever 7 to overcome the block or obstruction by the right-angle portion of the wedge-like projection 91. This arrangement prevents the user from erroneously being guided to pivotally rotate the control lever 7 to the shipping or initial position ① in an attempt to shift the control lever 7 to the operable position ②. Further, this arrangement is free from a problem of rise in production cost or increase in apparatus dimensions since only a minor modification is required for the formation of the wedge-like projection 91 on one of the edges defining the slot 9.

Next, referring to FIGS. 6A through 6C, description will be made about a track of pivotal rotation of the control lever 7 in the first and second embodiment fixing units, with regard to removal of a jammed sheet from between the pressing roller 5 and the heating roller 6. FIG. 6A is a diagram showing a track of pivotal rotation of the control lever 7 in the fixing unit 1 according to the first embodiment. FIGS. 6B and 6C are diagrams each showing a track of pivotal rotation of the control lever 7 in the fixing unit 1 according to the second embodiment. For sake of convenience of explanation, the trace of angular movement of the control lever 7 is developed in a plane in FIGS. 6A through 6C.

Referring to FIG. 6A, a user on service of maintenance is allowed to pivot or turn the control lever 7 from the maintenance position ③ or from the operable or normal-use position ② to the initial or shipping position ① without any blocking. Thus, the arrangement shown in FIG. 6A may lead a user to an erroneous operation of shifting the control lever 105 to the initial position ①. If the user attempts to activate the image forming apparatus with the control lever 105 set to the initial position ①, it is highly likely that the heating roller 6 may be overheated.

On the other hand, according to the fixing unit 1 of the second embodiment of this invention, as shown in FIG. 6B, the wedge-like projection 91 functions as the restricting member to block, by the right-angle portion 91*a*, the pivotal movement of the control lever 7 from the maintenance position ③ or from the normal-use or operable position ② to the initial or shipping position ①. Namely, a user is allowed to shift the control lever 7 to the initial position ① only when he or she intentionally turns the control lever beyond the wedge-like projection 91 avoiding the right-angle portion 91*a* or resiliently deforming wedge-like projection 91. This arrangement obviates a user from erroneously shifting the control lever 7 to the initial or shipping position ①.

Furthermore, since the wedge-like projection 91 is tapered at the portion 91*b* to reduce the extent of the projection downwardly, a user is allowed to pivotally rotate the control lever 7 with ease from the shipping position ① to the maintenance position ③ or to the normal-use or operable position ② without exerting an intentional large force in the upward direction as shown in FIG. 6C.

As mentioned above, the fixing unit 1 of the second embodiment has the restricting member in the form of, by for example, a wedge-like projection 91, for restricting the control lever 7 from shifting to the initial position ① from the maintenance position ③ or from the normal-use position ②. In addition, the above arrangement enables the user to shift the control lever 7 to the normal-use position without being led to an erroneous operation, since the control lever 7 is smoothly guided to pivot from the maintenance position ③ to the normal-use position ②.

It should be appreciated that this invention is not limited to the foregoing embodiments, and various modifications and alterations are applicable without departing from the scope and spirit of the invention as defined by attached claims. Followings are examples of such modifications or alternations.

(1) In the first embodiment, the adhesive strip member 10 is detachably attached to the strip member 10 such that the strip member 10 is removed from the knob 71 of the control lever 7 by pulling the strip member 10 generally in the same direction as that to pivot the control lever 7 to the operable or normal-use position. Alternatively, the strip member may be constructed such that part of the strip member 10 may be torn off or the strip member 10 may be elastically deformed by pulling the strip member 10 in the aforementioned direction to such an extent that the indication on the strip member 10 is no longer seen once the control lever has been moved to the normal-use position and that indication become unnecessary.

(2) The strip member 10 as the warning display member in the first embodiment has a sheet-like shape such as a filament tape. The warning display member may have a tubular or prismatic shape.

(3) In the foregoing embodiments, the control lever 7 extends through the slot 9 to be operated by the user. Instead, a manipulation member may be provided to slide along the slot and is linked with the control lever 7 to move the latter in the same way as in the case of above-mentioned embodiment.

(4) In the second embodiment, the restricting member has a wedge-like shape. Alternatively, the restricting member may have a rectangular or semicircular shape in cross section or other shape as far as the restricting member block the movement of the control lever to the shipping position. In case, the restricting member has the cross-sectional shape of rectangular or semicircular, the member requires force to make the control lever go over the restricting member even when the control lever is moved from the shipping position to the maintenance position or normal-use position. However, it is within the scope of the present invention so far as the restricting member has the function of blocking or obstructing the inadvertent movement of the control lever from the shipping position to the maintenance position or normal-use position to the normal-use position. In the cases of the rectangular and semicircular projection, it may be preferable that amount of projection is a little smaller than in the case of wedge-like projection to facilitate movement of the control lever over the restricting member.

This application is based on Japanese patent application No. 2001-391905 and No. 2001-390760 each filed on Dec. 25, 2001, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing unit for an image forming apparatus comprising:

a heating roller for fusing a toner image on a sheet;

a pressing roller which is rendered in pressing contact with the heating roller to form a nip between the heating roller and the pressing roller for the sheet being transported through the nip;

a control member selectively settable to a first position for keeping the pressing roller off the heating roller and to a second position for keeping the pressing roller in press-contact with the heating roller;

a manipulation member operable to shift the control member between the first and second positions; and an indication member for indicating necessity of shifting the control member from the first to second position before actuation of the fixing unit, the indication member being removably attached to the manipulation member such that removal of the indication member from the manipulation member is accompanied by the shifting of the control member from the first to second position.

2. The fixing unit according to claim 1, wherein the manipulation member includes a lever pivotable between a first lever position for setting the control member at the first position, and a second lever position for setting the control member at the second position, and the indication member is removably attached to the lever such that the lever moves from the first lever position to the second lever position when the indication member is operated to be removed from the lever.

3. An image forming apparatus provided with the fixing unit as claimed in claim 1.

4. A fixing unit for an image forming apparatus comprising:

a heating roller for fusing a toner image on a sheet;

a pressing roller which is rendered in pressing contact with the heating roller to form a nip between the heating roller and the pressing roller for the sheet being transported through the nip;

a control member selectively settable to a first position for keeping the pressing roller off the heating roller and to a second position for keeping the pressing roller in press-contact with the heating roller;

a manipulation member operable to shift the control member between the first and second positions; and an indication member for indicating necessity of shifting the control member from the first to second position before the actuation of the fixing unit, the indication member being associated with the manipulation member such that removal of the indication member is accompanied by the shifting of the control member from the first to second position, wherein the manipulation member includes a control lever pivotable between a first lever position for setting the control member at the first position, a second lever position for setting the control member at the second position, the indication member being associated with the control lever such that the control lever moves from the first lever position to the second lever position when the indication member is operated to be removed, and the indication member having a sheet-like form, and having a proximal end portion thereof detachably attached to the control lever on the back side of the control lever with respect to the direction of the movement of the control lever from the first to second lever position.

5. The fixing unit according to claim 4, wherein the indication member is attached to the control lever firmly enough to turn the control lever from the first to second lever position when the indication member is pulled, and the indication member may be removed from the control lever when the control lever reaches the second position.

6. A fixing unit for an image forming apparatus comprising:

a heating roller for fusing a toner image on a sheet;

a pressing roller which is rendered in pressing contact with the heating roller to form a nip between the heating roller and the pressing roller for the sheet being transported through the nip;

a control member selectively settable to a first position for keeping the pressing roller off the heating roller and to a second position for keeping the pressing roller in press-contact with the heating roller;

a manipulation member operable to shift the control member between the first and second positions; and an indication member for indicating necessity of shifting the control member from the first to second position before the actuation of the fixing unit, the indication member being associated with the manipulation member such that removal of the indication member is accompanied by the shifting of the control member from the first to second position, wherein the manipulation member includes a control lever pivotable between a first lever position for setting the control member at the first position, and a second lever position for setting the control member at the second position, the indication member being associated with the control lever such that the control lever moves from the first lever position to the second lever position when the indication member is operated to be removed, an opening being formed on the indication member, and the control lever having a projection at such a position that the projection extends through the opening of a warning display member while the indication member is attached to the control lever.

7. A fixing unit comprising:

a heating roller including a heating source;

a pressing roller which is rendered in pressing contact with the heating roller to form a nip between the heating roller and the pressing roller for the sheet being transported through the nip;

a control member selectively settable to a shipping position for keeping the pressing roller off the heating roller, to an operable position for keeping the pressing roller in press-contact with the heating roller, and to a maintenance position between the shipping position and the operable position for keeping the pressing roller at a maintenance position; and a blocking member for blocking the control member from shifting from the maintenance position or from the operable position to the shipping position.

8. The fixing unit according to claim 7, further comprising a covering member for covering the heating roller and the pressing roller, a guide portion formed in the covering member, and a control lever guided by the guide portion to shift among a first position associated with the shipping position of the control member, a second position associated with the maintenance position of the control member and a third position associated with the operable position of the control member, the guide portion extending in a region the first to third position of the control lever, and the guide member including a restricting member including a wedge-like projection for blocking the control lever from being shifted to the first position from the second position or from the operable third position, and for allowing the control lever to be guided from the first position to the second position or to the third position.

9. The fixing unit according to claim 8, wherein the control lever is shiftable to the first position from the second position or from the third position exclusively when an external force sufficient to overcome the blocking is applied to the control lever.

10. The fixing unit according to claim 7, further comprising a control lever which is pivotable about an axis of rotation thereof, and the control member is set to the shipping, maintenance and operable positions in accordance with an angular displacement of the control lever.

11. An image forming apparatus provided with the fixing unit as claimed in claim 7.

12. A fixing unit for an image forming apparatus comprising:

a heating roller for fusing a toner image on a sheet;

a pressing roller which is rendered in pressing contact with the heating roller to form a nip between the heating roller and the pressing roller for the sheet being transported through the nip;

a control member selectively settable to a first position for keeping the pressing roller off the heating roller and to a second position for keeping the pressing roller in press-contact with the heating roller;

a control lever pivotable between a first lever position for setting the control member at the first position, and a second lever position for setting the control member at the second position; and an indication member having a sheet-like form bearing an indication of necessity of shifting the control member from the first to second position before the actuation of the fixing unit, the indication member having a proximal end portion detachably attached to the control lever on the back side of the control lever with respect to the direction of the movement of the control lever from the first to second lever position such that removal of the indication member is accompanied by the shifting of the control lever from the first to second position.

13. The fixing unit according to claim 12, wherein an opening is formed on the indication member, and the control lever has a projection at such a position that the projection extends through the opening of the indication member while the indication member is attached to the control lever.

* * * * *